US005819611A

United States Patent [19]

Kozak

[11] Patent Number: 5,819,611

[45] Date of Patent: Oct. 13, 1998

[54] FASTENER REMOVING TOOL

[76] Inventor: Ira M. Kozak, 2475 Woodlawn Rd., Northbrook, Ill. 60062

[21] Appl. No.: 749,496

[22] Filed: Nov. 15, 1996

[51] Int. Cl.[6] ..... B25B 23/08

[52] U.S. Cl. ..... 81/451; 81/441; 81/453

[58] Field of Search ..... 81/120, 128, 441, 81/451–455, 90.1–90.3

[56] References Cited

U.S. PATENT DOCUMENTS

| | | | |
|---|---|---|---|
| 673,056 | 4/1901 | Jacobs . | |
| 1,129,049 | 2/1915 | Smith . | |
| 2,103,944 | 12/1937 | Gullborg . | |
| 3,517,714 | 6/1970 | Desbarats . | |
| 3,590,235 | 6/1971 | Leo et al. . | |
| 3,678,789 | 7/1972 | Wilson . | |
| 3,739,825 | 6/1973 | Knox . | |
| 3,901,298 | 8/1975 | Eby | 81/455 |
| 4,429,599 | 2/1984 | La Sante, Sr. . | |
| 4,569,259 | 2/1986 | Rubin et al. . | |
| 4,800,787 | 1/1989 | Cerny . | |
| 4,947,712 | 8/1990 | Brosnan . | |
| 5,052,250 | 10/1991 | Clarke et al. | 81/125 X |
| 5,450,776 | 9/1995 | Kozak . | |

*Primary Examiner*—James G. Smith
*Attorney, Agent, or Firm*—Cherskov & Flaynik

[57] ABSTRACT

In order to facilitate the removal of a fastener of the type having a head on a shank, a tool for removing such a fastener is disclosed. The tool includes support for a collet which makes it possible to impart torque for removal of the fastener through rotational movement of the collet in relation to the head of the fastener. Further, the collet is adjustably positioned on the support and is dimensionaly adjustable for gripping the head of the fastener.

22 Claims, 1 Drawing Sheet

FASTENER REMOVING TOOL

FIELD OF THE INVENTION

The present invention is generally related to fastener removing tools and, more particularly, a tool for removing a one-way fastener of the security fastener type.

BACKGROUND OF THE INVENTION

Security fasteners which are tamper-resistant or vandal-resistant are now well known. These fasteners typically have tamper-proof screw heads wherein the screw heads are adapted to be driven in a clockwise direction utilizing a conventional screw driving blade, and they are typically adapted to remain in a fully-installed condition without being able to be removed by further use of a conventional screwdriver blade when operated in a counterclockwise direction. However, security fasteners must occasionally be removed by authorized personnel.

In connection with a typical screw of the security type, it has a generally circular head with both flat and convex upper surface portions. While such a security fastener can be installed with a conventional screwdriver, there is a need for a special tool for removal thereof.

Over the years, there have been a variety of different proposals for tools to accomplish this particular objective. Among the various proposals are the tools which are disclosed in Gullborg U.S. Pat. No. 2,103,944; Cerny U.S. Pat. No. 4,800,787; and LaSante, Sr. U.S. Pat. No. 4,429,599. Unfortunately, each of these tools requires a specially-designed fastener which renders them less than desirable for any existing fastener applications.

More specifically, there would be a natural reluctance to utilize any of the tools which have been suggested in these earlier patents. They would not only be unsuitable for removing existing types of security fasteners but, equally important, they would require a substantial capital investment inasmuch as specially-designed screws would need to be manufactured and marketed. Clearly, the Gullborg '944 patent, the Cerny '787 patent, and the LaSante, Sr. '599 patent have failed to meet the need for a unique security fastener removal tool.

More recently, there was a significant advancement in security fastener removal tools which is disclosed and claimed in Kozak U.S. Pat. No. 5,450,776. There has remained, however, the need for still additional flexibility and, in particular, the capacity for both radial and axial adjustability of the tool components. Still additionally, there has remained the need for a fastener removing tool of a type which is well suited for removing any form of head-on-a-shank fastener.

The present invention is directed to overcoming one or more of the foregoing problems and achieving one or more of the resulting objects.

SUMMARY OF THE INVENTION

It is, therefore, a principal object of the present invention to provide a unique improved removal tool for use in removing a fastener of the type having a head on a shank. It is also an object of the present invention to provide a tool for removing the most commonly utilized security fasteners and, specifically, one-way fasteners of the type generally in widespread use to accommodate ease of removal of existing installed fasteners of this particular type. It is an additional object of the present invention to provide a tool for removing a fastener having a pair of both flat and convex head surface portions thereon.

Accordingly, the present invention is directed to a tool for removing a fastener of the type having a head on a shank wherein the tool includes means for supporting a collet. The collet supporting means supports the collet so as to be able to impart torque through rotational movement of the collet in relation to the head of the fastener. Further, the tool includes means for adjustably positioning the collet on the collet supporting means and the collet includes means for adjustably gripping the head of the fastener.

In the exemplary embodiment, the collet supporting means preferably includes an elongated shank and the collet positioning means includes a first portion of the collet. The elongated shank advantageously has an end to be placed in engagement with the head of the fastener which includes a pair of fastener engaging tips. Also in the exemplary embodiment, the fastener gripping means preferably includes a second portion of the collet axially spaced from the first collet portion so as to be near the head engagement end of the shank.

As for other details of the exemplary embodiment, the second collet portion suitably includes a plurality of teeth about an inner surface for biting into the head of the fastener. With this arrangement, the first collet portion preferably has a tightening collar with right hand threads and the second collet portion preferably has a tightening collar with left hand threads.

In a highly preferred embodiment, a tool for removing a one-way fastener of the type having a generally circular head with a flat upper surface portion and a convex upper surface portion is provided. The tool again advantageously includes an elongated shank having an end with a pair of fastener-engaging tips extending therefrom for engagement with the head of the one-way fastener. Still additionally, the tool again preferably includes a collet which is disposed on the shank such that rotational movement of the shank serves as to cause rotational movement to be imparted to the collet.

Still further, the tool preferably includes means for adjustably positioning the collet relative to the fastener-engaging tips to cause the collet and the fastener-engaging tips both to engage the head of the one-way fastener whereby rotational movement of the shank imparts torque to the head of the one-way fastener through rotational movement of the fastener engaging tips as well as rotational movement of the collet.

Still additional details of the present invention include the collet having means for adjustably gripping the head of the one-way fastener while the fastener-engaging tips are also in engagement with the head of the one-way fastener. The collet positioning means preferably includes a first collet portion and the fastener gripping means preferably includes a second collet portion axially spaced along the collet from the first collet portion. The first collet portion advantageously comprises a tightening collar threaded onto the collet with right hand threads and the second collet portion likewise advantageously comprises a tightening collar threaded onto the collet with left hand threads. The fastener gripping means preferably includes a plurality of teeth which are disposed about an inner surface of the collet for the purpose of biting into the head of the one-way fastener for imparting torque thereto. In a highly preferred embodiment, the teeth are each angled for counterclockwise biting engagement of the head of the one-way fastener about a radial line passing through an axis of rotational movement of the collet.

As will be appreciated, the teeth could, alternatively, extend radially, or they could be angled for clockwise rotation for removing a fastener having left-hand threads.

In yet another respect, the present invention is particularly well suited as a tool for removing a one-way fastener of the type having a threaded shank with right hand threads. The tool may further advantageously be formed as a double collet adapted to be adjustably secured to an elongated shank such that counterclockwise rotational movement of the shank causes counterclockwise rotational movement to be imparted to the double collet. With this arrangement, the double collet includes a first collet for adjustably positioning the fastener-engaging tips in relation to a second collet so that they both engage the head of the one-way fastener.

As for the second collet, it advantageously comprises means for adjustably gripping the head of the one-way fastener together with the fastener-engaging tips after the fastener-engaging tips have been adjustably positioned relative to the second collet using the first collet whereby counterclockwise rotational movement of the shank thereafter serves to impart torque to the head of the one-way fastener through the resulting counterclockwise rotational movement of the fastener-engaging tips as well as the resulting counterclockwise rotational movement of the second collet.

In a most highly preferred embodiment, the shank has an end of non-circular cross-section opposite the fastener-engaging tips to be manually or power driven to impart torque to the head for removing the one-way fastener. The double collet also preferably has a knurled intermediate segment between the first collet and the second collet and the collars of the first collet and the second collet are also preferably knurled. Furthermore, the fastener-engaging tips each advantageously have an angled surface to bite into the head of the one-way fastener whenever torque is imparted through counterclockwise rotational movement of the tool.

Other objects, advantages and features of the present invention will become apparent from a consideration of the following specification taken in conjunction with the accompanying drawings.

DETAILED DESCRIPTION OF THE PREFERRED EMBODIMENT

Figure 1:
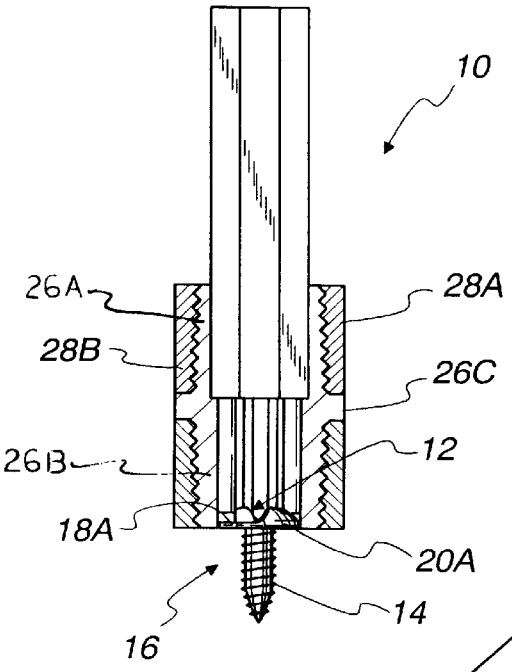
FIG. 1 is a view partially in section of a fastener removing tool in accordance with the present invention.
Figure 4:
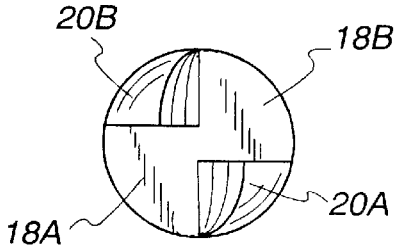
FIG. 4 is a top plan view of a one-way fastener of the general type which is to be removed with the tool of FIG. 1.

In the illustrations given, and with reference first to FIG. 1, the reference numeral 10 designates generally a tool for removing a fastener of the type having a head 12 on a threaded shank 14. The fastener may be of any type having a head and shank, although one particular application for the tool 10 is for removing a one-way fastener such as that illustrated and designated 16 in which the head 12 is circular and has a pair of flat upper surface portions 18*a* and 18*b* together with a pair of convex upper surface portions 20*a* and 20*b* (see FIG. 4). As will be appreciated from FIG. 4, the respective flat upper surface portions 18*a* and 18*b* and convex upper surface portions 20*a* and 20*b* are located generally in diametrically opposite quadrants.

Figure 3:
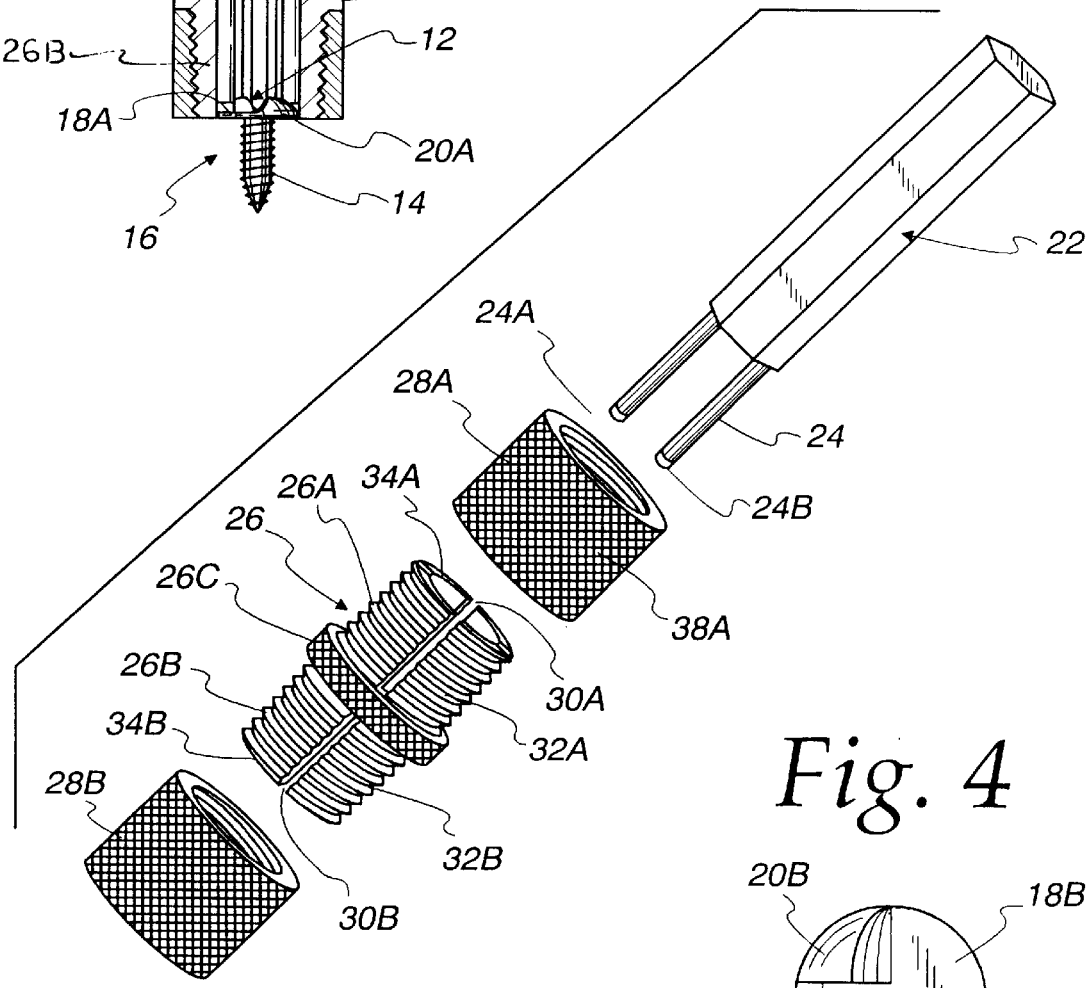
FIG. 3 is an exploded perspective view of the fastener removing tool illustrated in FIG. 1.

Referring to FIGS. 1 and 3, the tool 10 includes an elongated shank 22 having an end 24 which is suitably designed to be placed in engagement with the head 12 of the one-way fastener 16 in the form of a pair of fastener-engaging tips 24*a* and 24*b*. It will be seen and appreciated that the tips 24*a* and 24*b* extend from the shank for engagement with the head 12 of the one-way fastener 16. In addition, the tool 10 includes a double collet generally designated 26 to be positioned on the shank 22 which includes means for adjustably gripping the head 12 of the one-way fastener 10 as will be described in greater detail hereinafter.

As perhaps best shown in FIG. 1, the double collet 26 is adapted to be axially adjustably secured to the elongated shank 22 such that counterclockwise rotational movement of the shank 22 causes counterclockwise rotational movement to be imparted to the double collet 26. It will be seen and appreciated by considering FIGS. 1 and 3 that the double collet 26 includes a first collet or collet portion 26*a* for adjustably positioning the fastener-engaging tips 24*a* and 24*b* in relation to a second collet or collet portion 26*b* so as to thereby cause the second collet or collet portion 26*b* and the fastener-engaging tips 24*a* and 24*b* to both simultaneously engage the head 12 of the one-way fastener 16. As will also be described in detail hereinafter, the second collet or collet portion 26*b* comprises means for adjustably gripping the head 12 of the one-way fastener 16 together with the fastener-engaging tips 24*a* and 24*b* after the fastener-engaging tips have been adjustably positioned using the first collet or collet portion 26*a*.

With regard to the double collet 26, the first collet or collet portion 26*a* includes a tightening collar 28*a* threaded onto the double collet 26 with right hand threads and the second collet or collet portion 26*b* includes a tightening collar 28*b* threaded onto the double collet 26 with left hand threads. The double collet 26 will be seen to be formed in the preferred embodiment so as to have a radially enlarged central portion 28*c* which preferably has a knurled outer surface, and the first and second collets or collet portions 26*a* and 26*b* will be seen to have a plurality of axially extending slots such as 30*a* and 30*b* with the outer surface of the first and second collets or collet portions 26*a* and 26*b* having right hand threads and left hand threads as shown at 32*a* and 32*b*, respectively. With this structure, the tightening collars 28*a* and 28*b* may be threaded onto the first and second collets or collet portions 26*a* and 26*b* using respective internal right and left hand threads (not shown) to adequately tighten the double collet 26 on the shank 22 and the head 12 of the fastener 16.

In typical collet fashion, the tightening collars 28*a* and 28*b* may be threaded onto the respective ones of the first collet or collet portion 26*a* and second collet or collet portion 26*b* to cause them to be adjustably secured to the shank 22 and to grip the head 12 of the fastener 16 . The inner surface of the first and second collets or collet portions 26*a* and 26*b* may be generally circular in cross-section (or, alternatively, at least the inner surface of the first collet or collet portion 26*a* may be hexagonal to conform to a hexagonal shaped shank 22) and the outer surface bearing the threads as at 32*a* and 32*b* may be slightly tapered to a marginally larger diameter from the respective ends 34*a* and 34*b* in a direction toward the intermediate knurled portion 26*c*. Thus, the inner diameters or dimensions of the first and second collets or collet portions 26*a* and 26*b* are reduced as the collars 28*a* and 28*b* are threaded onto the threads as at 32*a* and 32*b* using the right and left hand threads in a direction toward the intermediate knurled portion 26*c*.

As mentioned above , the inner surface of the first collet or collet portion 26*a* may be formed to be of a non-circular cross-section which conforms to the hexagonal outer surface of the shank 22 as an alternative structure. Thus, the shank 22 may advantageously be formed to be hexagonal in shape so as to be received in a power tool such as a cordless portable electric screwdriver in which case the inner surface of the first collet or collet portion 26*a* may similarly be shaped so as to have a hexagonal cross-section. In any event, the inner surface of the first collet or collet portion 26*a* will be dimensioned so as to receive the shank 22 when the collar 28*a* is threaded to a loosened position axially spaced from the intermediate knurled portion 26*c*.

Of course, the inner surface of the first collet or collet portion 26*a* will be dimensioned sufficiently close to the outer dimension of the shank 22 as to be tightly secured to the shank 22 when the collar 28*a* is threaded to a tightened position axially adjacent the intermediate knurled portion 26*c*.

Figure 2:
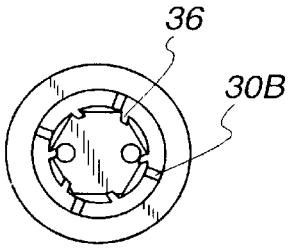
FIG. 2 is an end elevational view of the fastener removing tool illustrated in FIG. 1.

With regard to the second collet or collet portion 26*b* of the double collet 26, it will be seen to include fastener gripping means preferably in the form of a plurality of teeth 36 disposed about an inner surface for biting into the head 12 of the one-way fastener 16 for imparting torque thereto. The teeth 36 are preferably each angled for biting engagement of the head 12 of the one-way fastener 16 about a radial line passing through an axis of counterclockwise rotational movement of the double collet 26 as best illustrated in FIG. 2. Accordingly, the collar 28*b* may be threaded onto the second collet or collet portion 26*b* to reduce the inner diameter thereby causing the teeth 36 to tightly bite into the head 12 of the one-way fastener 16 by using the left hand threads in a manner similar to that described in connection with the collar 28*a*.

As previously discussed, the double collet 26 has a knurled intermediate segment 28*c* between the first collet or collet portion 26*a* and the second collet or collet portion 26*b* and the respective collars 28*a* and 28*b* of the first and second collets or collet portions 26*a* and 26*b* are also preferably knurled. The respective knurling particularly accommodates hand tightening as well as tool tightening of the collars 28*a* and 28*b*. Moreover, the second collet or collet portion 26*b* and the corresponding collar 28*b* preferably use left hand threads so that there is a tendency to further tighten the second collet or collet portion 26*b* to more deeply imbed the teeth 36 into the head 12 of the one-way fastener 16 during a fastener removal operation.

As best shown in FIG. 3, the fastener-engaging tips 24*a* and 24*b* each preferably have an angled surfaces which are formed so as to cause them to also bite into the head 12 of the one-way fastener 16 when torque is imparted through counterclockwise rotational movement of the tool 10. If the fastener-engaging tips 24*a* and 24*b* and the second collet or collet portion 26*b* are positioned such that the tips 24*a* and 24*b* and the teeth 36 can all bite into the head 12 of the one-way fastener 16, the tool 10 is extremely effective in removing any one-way fastener 16.

From the foregoing, it has previously been discussed that the shank 22 can be formed in a hexagonal shape which is highly advantageous for the utilization of a cordless portable electric screwdriver. However, as will also be appreciated, the shank 22 could be made integral with a handle in normally conventional manual screwdriver fashion to provide a unique, improved manual fastener removal tool as well.

Also, in the foregoing description, the tool 10 has been described for use with removing a one-way fastener of the type having a generally circular head 12 with a pair of flat upper surface portions 18*a* and 18*b* and a pair of convex upper surface portions 20*a* and 20*b*. It will be appreciated, however, that the tool 10 has much broader applicability for removing any fastener of the type having a head on a shank which could include, but not be limited to, flat head screws, pan head screws, and the like. For all such applications, the fastener-engaging tips 24*a* and 24*b* may be utilized to back the fastener out and/or the second collet or collet portion 26*b* can be utilized to cause the teeth 36 to bite into the head for complete removal thereof.

While in the foregoing there has been set forth a preferred embodiment of the invention, it will be appreciated that the details herein given may be varied by those skilled in the art without departing from the true spirit and scope of the appended claims.

I claim:

1. A tool for removing a fastener of the type having a head on a shank, the tool comprising:

means for supporting a collet in a manner so as to be able to impart torque through rotational movement of said collet in relation to said head of said fastener;

a collet comprising a first portion and a second portion, with said second portion including a means for adjustably gripping said head of said fastener, and wherein said collet portions are independently adjustable from each other.

2. The fastener removing tool of claim 1 including means for adjustably positioning said collet on said collet supporting means.

3. The fastener removing tool of claim 2 wherein said first portion is adapted to receive said supporting means and wherein said collet supporting means includes an elongated shank.

4. The fastener removing tool of claim 3 wherein said elongated shank has an end to be placed in engagement with said head of said fastener including a pair of fastener engaging tips.

5. The fastener removing tool of claim 3 wherein said second collet portion is axially spaced along said collet from said first collet portion.

6. The fastener removing tool of claim 1 wherein each said collet portions are independently adjusted by means of a threaded collar.

7. A tool for removing a fastener of the type having a head on a shank, comprising:

means for supporting a collet in a manner so as to be able to impart torque through rotational movement of said collet in relation to said head of said fastener;

a collet, including means for adjustably gripping said head of said fastener;

means for adjustable positioning said collet on said collet supporting means wherein said collet supporting means includes an elongated shank and said collet positioning means includes a first collet portion and wherein said fastener gripping means includes a second collet portion axially spaced along said collet from said first collet portion; and wherein said second collet portion includes a plurality of teeth about an inner surface for biting into said head of said fastener.

8. A tool for removing a fastener of the type having a head on a shank, comprising:

means for supporting a collet in a manner so as to be able to impart torque through rotational movement of said collet in relation to said head of said fastener;

a collet including means for adjustable gripping said head of said fastener;

means for adjustably positioning said collet on said collet supporting means, wherein said collet supporting means includes an elongated shank and said collet positioning means includes a first collet portion, and wherein said fastener gripping means includes a second collet portion axially spaced along said collet from said first collet portion; and wherein said first collet portion has a collar with right hand threads and second collet portion has a collar with left hand threads.

9. A tool for removing a one-way fastener of a type having a generally circular head with an upper surface comprising four diametrically opposed portions, with two of said diametrically opposed portions being flat, and two of said diametrically opposed portions being convex, comprising:

an elongated shank having an end to be placed in engagement with said head of said one-way fastener, said end of said shank having a pair of fastener-engaging tips extending therefrom for engagement with said head of said one-way fastener, and a collet comprising a first collet portion and a second collet portion that are independently adjustably, with said second collet portion including means for adjustably gripping said head of said one-way fastener;

said first collet portion being adapted to be disposed on said shank such that said rotational movement of said shank causes rotational movement to be imparted to said collet; and means for adjustably positioning said second collet portion relative to said fastener-engaging tips to cause said second collet portion and said fastener-engaging tips both to engage said head of said one-way fastener;

whereby rotational movement of said shank imparts torque to said head of said of said one-way fastener through rotational movement of said fastener engaging tips and said collet.

10. The fastener removing tool of claim 9 wherein said fastener gripping means is adjustable to grip said head of said one-way fastener while said fastener-engaging tips are also in engagement with said head of said one-way fastener.

11. The fastener removing tool of claim 9 wherein said second collet portion is axially spaced along said collet from said first collet portion.

12. The fastener removing tool of claim 11 wherein said first collet portion includes a collar threaded onto said collet with right hand threads and said second collet portion includes a collar threaded onto said collet with left hand threads.

13. The fastener removing tool of claim 9 wherein said fastener gripping means includes a plurality of teeth disposed about an inner surface of said collet for biting into said head of said one-way fastener for imparting torque thereto.

14. The fastener removing tool of claim 13 wherein said teeth are each angled for counterclockwise biting engagement of said head of said head of said one-way fastener about a radial line passing through an axis of rotational movement of said collet.

15. The fastener removing tool of claim 9 wherein said shank has an end of non-circular cross-section opposite said fastener-engaging tips to be manually or power driven to impart torque to said head for removing said one-way fastener.

16. A tool for removing a one-way fastener of a type having a generally circular head with an upper surface comprising four diametrically opposed portions, with two of said diametrically opposed portions being flat, and two of said diametrically opposed portions being convex, with said flat portions and said convex portions constituting alternate sectors of said upper surface of said circular head, said head being integral with a threaded shank having right hand threads comprising:

an elongated shank having an end to be placed in engagement with said head of said one-way fastener, said end of said shank having a pair of fastener engaging tips extending therefrom for engagement with said head of said one-way fastener, and a collet with a first collet portion and a second collet portion on said shank with said collet portions being independently adjustable;

said first collet portion being adapted to be adjustably secured to said shank such that counterclockwise rotational movement of said shank causes counterclockwise rotational movement to be imparted to said double collet; and said first collet portion adapted for adjustably positioning said fastener-engaging tips in relation to said second collet portion to cause second collet portion and said fastener engaging tips both to engage said head of said one-way fastener;

said second collet portion comprising means for adjustably gripping said head of said one-way fastener together with said fastener-engaging tips after said fastener-engaging tips have been adjustably positioned with said first collet portion;

whereby counterclockwise rotational movement of said shank imparts torque to said head of said head of said one-way fastener through counter clockwise rotational movement of said fastener-engaging tips and said second collet.

17. The fastener removing tool of claim 16 wherein said first collet includes a collar threaded onto said double collet with right hand threads and said second collet includes a collar threaded onto said double collet with left hand threads.

18. The fastener removing tool of claim 16 wherein said fastener gripping means includes a plurality of teeth about an inner surface of said second collet for biting into said head of said one-way fastener for imparting torque thereto.

19. The fastener removing tool of claim 18 wherein said teeth are each angled for biting engagement of said head of said one-way fastener about a radial line passing through an axis of counterclockwise rotational movement of said double collet.

20. The fastener removing tool of claim 16 wherein said shank has an end of non-circular cross-section opposite said fastener-engaging tips to be manually or power driven to impart torque to said head for removing said one-way fastener.

21. The fastener removing tool of claim 17 wherein said double collet has a knurled intermediate segment between said first collet and said second collet and said collars of said first collet and said second collet are also knurled.

22. The fastener removing tool of claim 16 wherein said fastener-engaging tips each have an angled surface to bite into said head of said one-way fastener when torque is imparted through counterclockwise rotational movement of said tool.

* * * * *

UNITED STATES PATENT AND TRADEMARK OFFICE

CERTIFICATE OF CORRECTION

PATENT NO. : 5,819,611
DATED : October 13, 1998
INVENTOR(S) : Ira M. Kozak

It is certified that error appears in the above-indentified patent and that said Letters Patent is hereby corrected as shown below:

Column 7, line 22, after the word "independently" delete the word "adjustably" and insert the word --adjustable--.

Column 7, line 35, after the word "head" delete the words "of said " (first occurrence).

Column 7, line 56, after the word "head" delete the words "of said head "

Column 8, line 31, after the word "head" delete the words "of said head "

Signed and Sealed this

Nineteenth Day of January, 1999

*Attest:*

*Attesting Officer*

*Acting Commissioner of Patents and Trademarks*